US010505293B2

(12) United States Patent
Wagner et al.

(10) Patent No.: US 10,505,293 B2
(45) Date of Patent: Dec. 10, 2019

(54) HIGHSPEED BOARD CONNECTOR

(71) Applicant: HUBER+SUHNER AG, Herisau (CH)

(72) Inventors: Martin Wagner, Steinach (CH); Haris Beganovic, Wittenbach (CH)

(73) Assignee: HUBER+SUHNER AG, Herisau (CH)

( * ) Notice: Subject to any disclaimer, the term of this patent is extended or adjusted under 35 U.S.C. 154(b) by 0 days.

(21) Appl. No.: 16/060,756

(22) PCT Filed: Jan. 12, 2017

(86) PCT No.: PCT/EP2017/050577
§ 371 (c)(1),
(2) Date: Jun. 8, 2018

(87) PCT Pub. No.: WO2017/125314
PCT Pub. Date: Jul. 27, 2017

(65) Prior Publication Data

US 2018/0366844 A1 Dec. 20, 2018

(30) Foreign Application Priority Data

Jan. 18, 2016 (CH) ..... 62/16

(51) Int. Cl.
*H01R 13/187* (2006.01)
*H01R 13/512* (2006.01)
(Continued)

(52) U.S. Cl.
CPC ..... *H01R 9/0515* (2013.01); *H01R 13/187* (2013.01); *H01R 13/512* (2013.01);
(Continued)

(58) Field of Classification Search
CPC ..... H01R 24/50; H01R 13/2421; H01R 13/6315; H01R 12/714; H01R 2201/20; H01R 12/728; H01R 9/0515
See application file for complete search history.

(56) References Cited

U.S. PATENT DOCUMENTS 4,740,746 A * 4/1988 Pollock ..... G01R 1/06722 324/72.5
6,758,680 B2 * 7/2004 Duquerroy ..... H01R 24/50 439/63

(Continued)

FOREIGN PATENT DOCUMENTS

WO WO 98/43323 10/1998
WO WO 2010/075325 A1 7/2010
WO WO 2010/075336 A1 7/2010

*Primary Examiner* — James Harvey
*Assistant Examiner* — Matthew T Dzierzynski
(74) *Attorney, Agent, or Firm* — Pauley Erickson & Kottis

(57) ABSTRACT

A connector assembly includes a first connector and a second connector. The first connector includes a housing holding at least one jack assembly with an inner conductor and an outer conductor arranged coaxial to the inner conductor. The second connector includes a socket with at least one opening extending in an axial direction. The opening includes a contact surface which in a mated position is electrically interconnected to an outer conductor of the jack assembly. In a direction of the axial extension (z-direction) of the opening, a contact surface is arranged which in the mated position is electrically interconnected to the inner conductor of the first connector part.

20 Claims, 4 Drawing Sheets

(51) Int. Cl.

| | |
|---|---|
| ***H01R 13/629*** | (2006.01) |
| ***H01R 13/66*** | (2006.01) |
| ***H01R 9/05*** | (2006.01) |
| ***H01R 24/50*** | (2011.01) |
| *H01R 12/71* | (2011.01) |

(52) U.S. Cl.
CPC ..... *H01R 13/629* (2013.01); *H01R 13/6658* (2013.01); *H01R 24/50* (2013.01); *H01R 12/714* (2013.01)

(56) References Cited

U.S. PATENT DOCUMENTS 7,097,460 B2 * 8/2006 Clark ..... H01R 13/6315 439/63
7,416,418 B2 * 8/2008 Berthet ..... H01R 24/50 439/63
7,597,588 B1 * 10/2009 Hyzin ..... H01R 13/2421 439/578
7,946,892 B2 * 5/2011 Carboni ..... H01R 13/2421 439/660
7,972,173 B1 * 7/2011 Hyzin ..... H01R 13/2421 439/578
8,360,807 B2 * 1/2013 Buff ..... H01R 13/6315 439/581
8,641,446 B1 * 2/2014 Chen ..... H01R 24/52 439/141
9,130,328 B1 9/2015 Huang et al.
10,069,257 B1 * 9/2018 Soubh ..... H01R 24/40
2004/0110424 A1 6/2004 Lin et al.
2008/0003852 A1 * 1/2008 Xu ..... H01R 13/2421 439/131
2010/0330838 A1 12/2010 Buff et al.
2013/0330944 A1 12/2013 Rucki et al.
2015/0072566 A1 * 3/2015 Hatch ..... H01R 13/514 439/700
2015/0280372 A1 10/2015 Huang et al.

* cited by examiner

HIGHSPEED BOARD CONNECTOR

BACKGROUND OF THE INVENTION

Field of the Invention

The present invention relates to a board connector assembly having a first and a second connector.

Description or Discussion of Prior Art

To test PCB (Printed Circuit Boards) it is necessary to quickly connect and disconnect a connector having a high density of channels.

US2010330838 originates from the same applicant and was first published in 2009. It describes a multiple coaxial cable plug connection, particularly for the detachable connection of a plurality of coaxial cables to a circuit board for operating frequencies of several GHz. It comprises a first connector and a second connector, wherein said connectors can be inserted in each other along a plug axis, wherein the first connector has a plurality of first coaxial contact arrangements disposed next to each other transversely to the plug axis. A second connector is equipped with second coaxial contact arrangements that match the first coaxial contact arrangements. The first coaxial contact arrangements each are attached to the end of an associated coaxial cable. High precision of the connection and at the same time a reduced insertion force are achieved in such a multiple coaxial cable plug connection in that the first coaxial contact arrangements are floatingly supported in a first housing while the second coaxial contact arrangements are permanently installed in a second housing.

US2015280372, assigned to Insert Enterpr. Co. Ltd., was first published in 2014 and describes a RF-pass-through connector which comprises at least a spring-loaded terminal comprised of a rod member. In addition, it comprises a sleeve member resiliently telescopically formed in a housing and adapted to be correspondingly contacted with a signal terminal formed in a socket. Furthermore, a receptacle cavity in the socket is to be electrically connected with a grounding loop formed in a circuit board fixed in an electronic device.

US2013330944, assigned to Andrew LLC, was first published in 2012. It describes a connector assembly to be blindly mated with a printed circuit board. The connector assembly comprises a housing and at least one RF interconnect. The RF interconnect comprises an outer conductor, an insulator and an inner conductor that function in a manner similar to the outer conductor, insulator and inner conductor of a coaxial cable, respectively. The inner conductor comprises a spring-loaded electrical contact such as a POGO pin. An upper end of the outer conductor is electrically coupled to the housing and a lower end of the outer conductor is configured to electrically couple to a ground return path of the printed circuit board. In its normally extended position, the spring-loaded contact extends beyond the lower end of the outer conductor, and the outer conductor limits the compression distance of the spring-loaded contact.

WO10075325 and WO10075336, both assigned to Molex Inc., were first published in 2010. They describe different embodiments of a coaxial connector, which is attached to a circuit board having a land that includes a housing, a terminal which projects from the housing and which is brought into contact with the land. A separate component is attached to the circuit board which has an inclined surface with which the housing is brought into contact in a state that the separate component is attached to the circuit board. The connector is capable of performing wiping even when the terminal has coaxial structure, regardless of the terminal structure. Per channel a spring loaded pin arranged in the centre is pressed against a contact surface thereby providing connection.

SUMMARY OF THE INVENTION

One aim of the invention is to provide a high density board connector assembly with simple and low cost connector-receptacle part on a board side which can be considered lost after testing. A further object of the invention is to provide a high density board connector assembly which offers improved return loss and insertion loss performance for broad frequency range (e.g. DC to 85 GHz). A further object of the invention is to provide a high density board connector assembly which offers quick and easy connection and disconnection of the connectors.

A connector assembly according to the invention comprises a first connector and a second connector which are interconnectable to each other. While the first connector is normally attached to at least one coaxial cable, the second connector is foreseen to be attached to a printed circuit board. The first connector comprises a housing holding at least one jack assembly arranged in an axial direction (mating direction). The jack assembly comprises an inner conductor and an outer conductor arranged coaxial to the inner conductor. The second connector comprises a socket with at least one opening extending in the axial direction. The opening comprising a first contact surface. The first contact surface is in a mated position electrically interconnected to an outer conductor of the jack assembly in a radial direction (at least partially perpendicular to the axial direction). In the axial direction of the opening, a second contact surface is arranged, which in the mated position is electrically interconnected to the inner conductor of the first connector part. The second contact surface is preferably arranged on a printed circuit board (e.g. is forming part thereof) to which the socket is attached, perpendicular to the axial direction. Depending on the field of application the second contact surface can form part of a separate element. The inner conductor of the jack assembly preferably comprises a pin which is arranged displaceable in the axial direction. Good results are achieved if the pin is arranged displaceable against the force of a spring. The pin may be arranged in a bushing forming part of the inner conductor and comprising contact fingers arranged in a circumferential direction around and in electrical contact with the pin. The contact fingers are pretensioned and press in a defined manner against an outer surface of the pin. Depending on the embodiment, inverse arrangement can be possible. While the pin is displaced against the force of the spring the contact fingers slide along the outer surface of the pin forming a defined electrical contact between the pin and the bushing. By arranging the contact fingers at the bushing in a pretensioned manner, very good transmission results can be achieved even at very high transmission frequencies. Further details can be found in the drawings which describe a jack assembly comprising a pin and a bushing as mentioned above. The socket, which can have a multi-part design, is preferably made at least partially from a conductive material or is at least partially covered by a conductive material. The socket can be made from injection molded plastic material which is then at least partially covered by a conducting material. The second contact surface may be a conductor path or maybe directly or indirectly interconnected to a conductor path of a printed circuit board. For better interconnection the first contact surface may comprise or is arranged adjacent to a funnel shaped lead-in surface. The opening may comprise at least one restriction in the form of circumferential first bead arranged inside the opening in the socket protruding radially inward above the first contact surface. Good results regarding return loss and insertion loss performance for broad frequency range can be achieve if the restriction is arranged in axial direction between the first and the second contact surface.

The first connector may comprise a housing suitable to mechanically mate with the socket directly or indirectly, e.g. by direct interaction or via the printed circuit board on which the socket is arranged. For pre-alignment and to avoid wrong orientation of the connectors good results are achieved if the housing and the socket interact during mating of the first and the second connector. Thereby the at least one jack assembly held by the housing of the first connector and the thereto related opening in the socket of the second connector can be pre-aligned with respect to each other.

Alternatively or in addition the first connector may comprise first means which prevent wrong connection of the first connector to the second connector. The first means are preferably arranged such that they can interconnect to second means arranged at the socket and/or the printed circuit board only in one way. The first means can be one or several pins which in a mated position interact with correspondingly arranged holes as shown in the drawings hereinafter. The holes can be arranged at the printed circuit board and/or the socket of the second connector. If appropriate, first and second locking means can be foreseen to at least temporarily interconnect the first connector and the second connector in a mounted position to each other. The first and the second locking means may e.g. be based on a magnetic connection and/or a snap connection and/or a screw connection. In a preferred embodiment comprising more than one jack assembly, at least one jack assembly is arranged in a floating manner at least in a lateral direction. The at least one jack assembly may be mechanically interconnected to the housing of the first connector part by a fixation element. The first connector may comprise means to protect the at least one inner conductor. The means to protect the inner conductor may comprise a protective element which is arranged displaceable with respect to the housing of the first connector. An example thereof comprising a casing arranged displaceable with respect to the housing of the first connector is shown in the drawings.

For interconnecting a first connector and a second connector to form a board connector assembly normally the following method steps are performed: Arranging a first connector spaced a distance apart in the axial direction above a second connector, wherein said second connector comprises a socket being arranged on and interconnected to a printed circuit board. Moving the first connector in the axial direction to the second connector until a crown contact of an outer conductor of at least one jack assembly described hereinafter held by a housing of the first connector interacts with a first contact surface of the socket of the second connector in radial direction. Continue moving the first connector in the axial direction (mating direction) with respect to the second connector until a pin of the jack assembly contacts a second contact surface in the axial direction. Normally the first connector is moved against the second connector until the pin is displaced against the force of a spring until a sufficient contact pressure is reached. The outer conductor of the jack assembly may comprise a crown contact with contact fingers with contact zones protruding in radial direction and which are deformed in the radial direction when interacting with the first contact surface thereby forming a secure connection.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

The herein described invention will be more fully understood from the detailed description given herein below and the accompanying drawings which should not be considered limiting to the invention described in the appended claims.

DETAILED DESCRIPTION OF THE INVENTION

Reference will now be made in detail to certain embodiments, examples of which are illustrated in the accompanying drawings, in which some, but not all features are shown. Indeed, embodiments disclosed herein may be embodied in many different forms and should not be construed as limited to the embodiments set forth herein; rather, these embodiments are provided so that this disclosure will satisfy applicable legal requirements. Whenever possible, like reference numbers will be used to refer to like components or parts.

Figure 1:
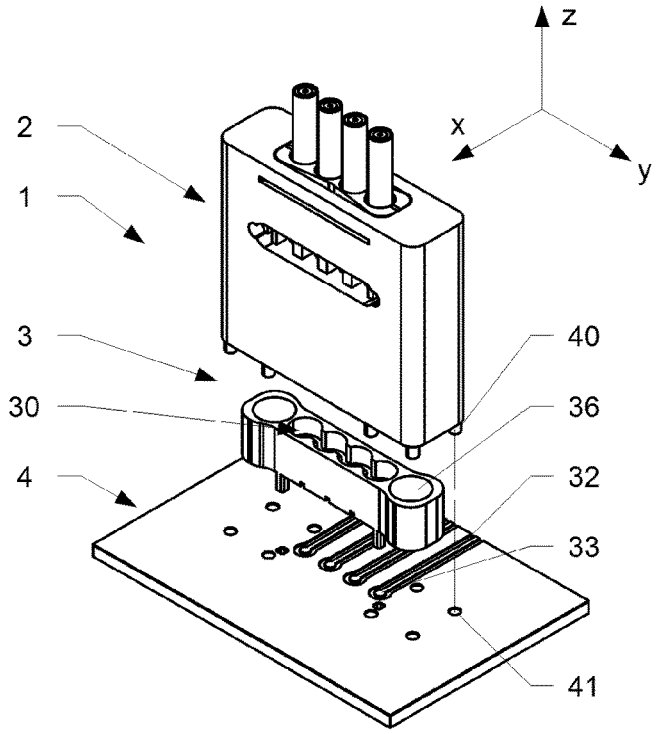
FIG. 1 A first embodiment of a board connector assembly.
Figure 2:
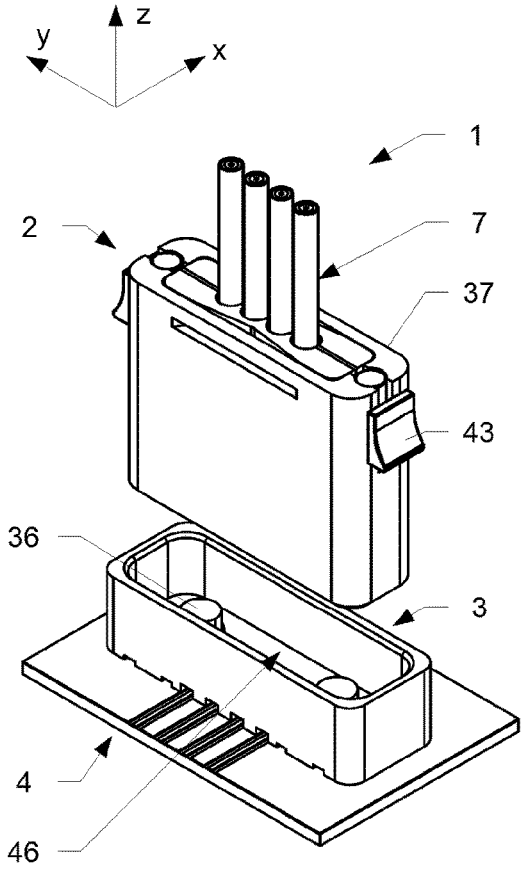
FIG. 2 A second embodiment of a board connector assembly.
Figure 3:
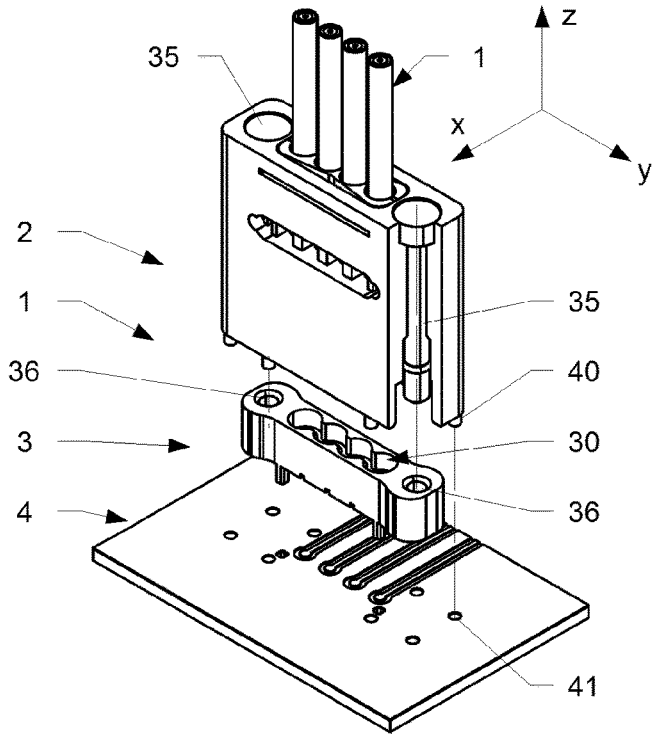
FIG. 3 A third embodiment of a board connector assembly in a partially cut manner.

FIG. 1 shows a first variation of a high density board connector assembly (board connector assembly) 1 in a perspective manner. FIG. 2 shows a second variation of the board connector assembly 1 and FIG. 3 shows a third variation of the board connector assembly 1 in a perspective manner. The board connector assemblies 1 each comprise a first connector 2 and a second connector 3. While the first connector 2 is typically arranged on the cable side, the second connector 3 is foreseen to be mounted on a printed circuit board (PCB) 4, or the like.

Figure 4:
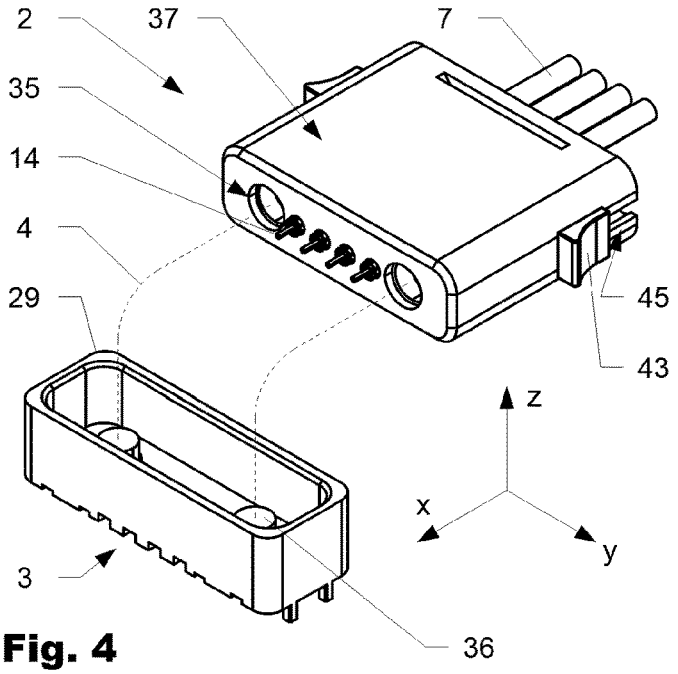
FIG. 4 Mating of a first and a second connector part (based on the example of the second embodiment)
Figure 5:
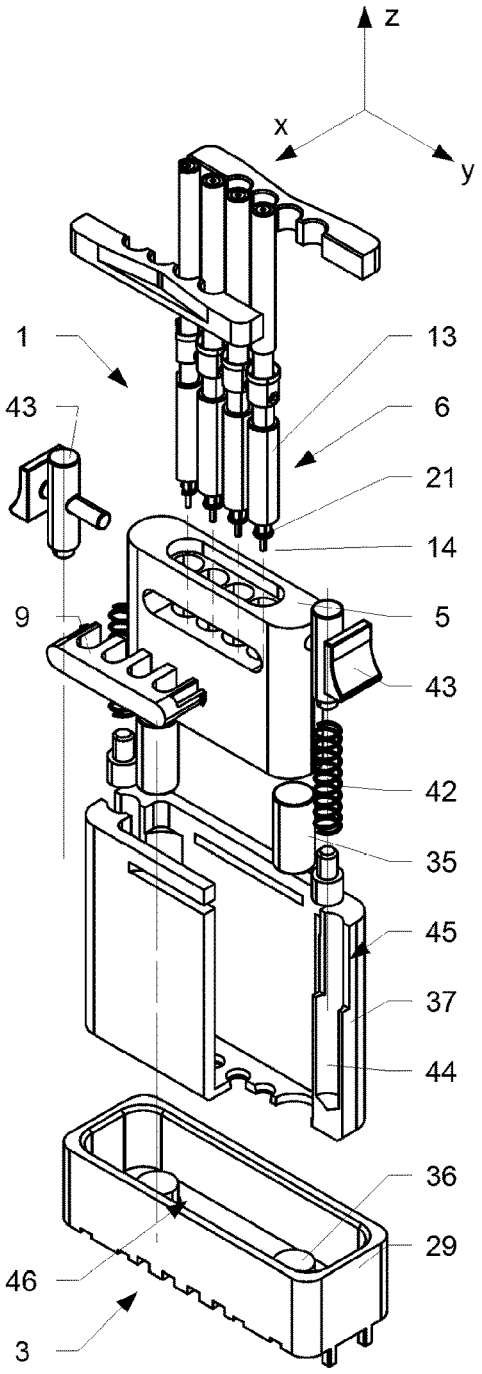
FIG. 5 The second embodiment in an exploded manner.
Figure 6:
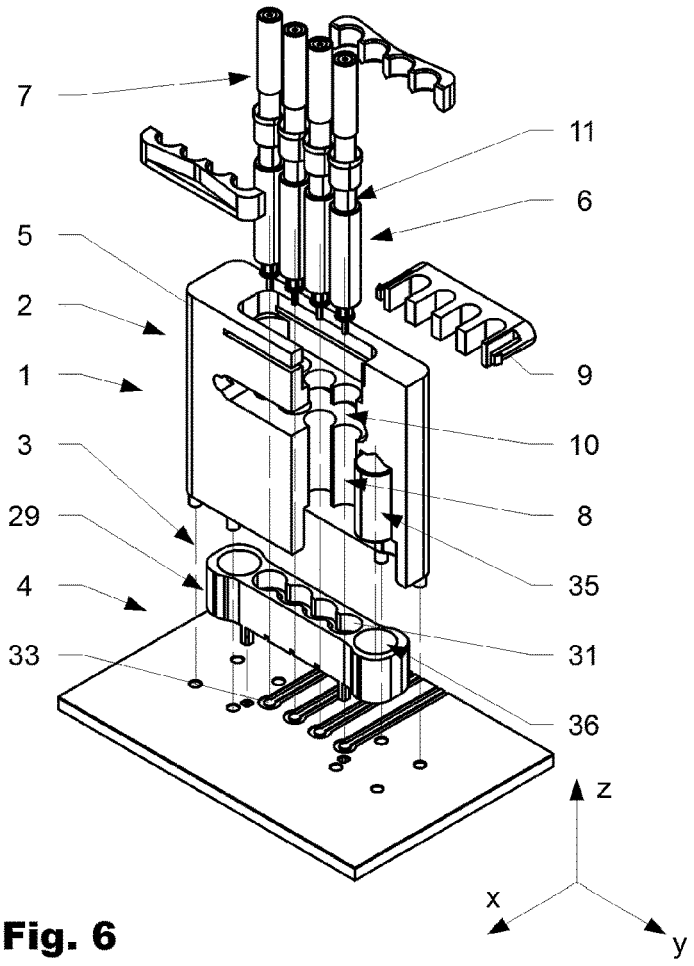
FIG. 6 The first embodiment in an exploded manner.

FIG. 4 shows the first and the second connectors 2, 3 of the second variation in an unlocked position. FIG. 5 shows the board connector assembly 1 according to the second variation in an exploded view. FIG. 6 shows the connector 1 according to the first variation in an exploded view.

Figure 7:
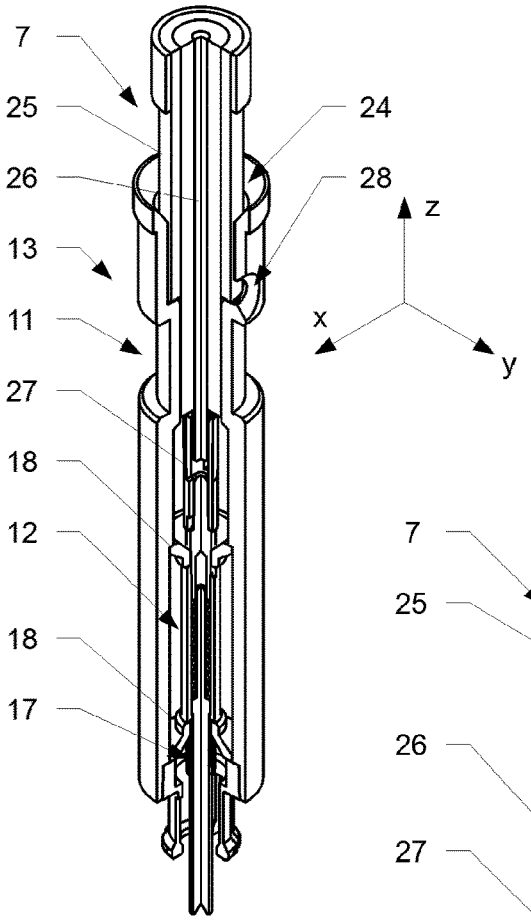
FIG. 7 A variation of a jack assembly in a partially cut manner.
Figure 8:
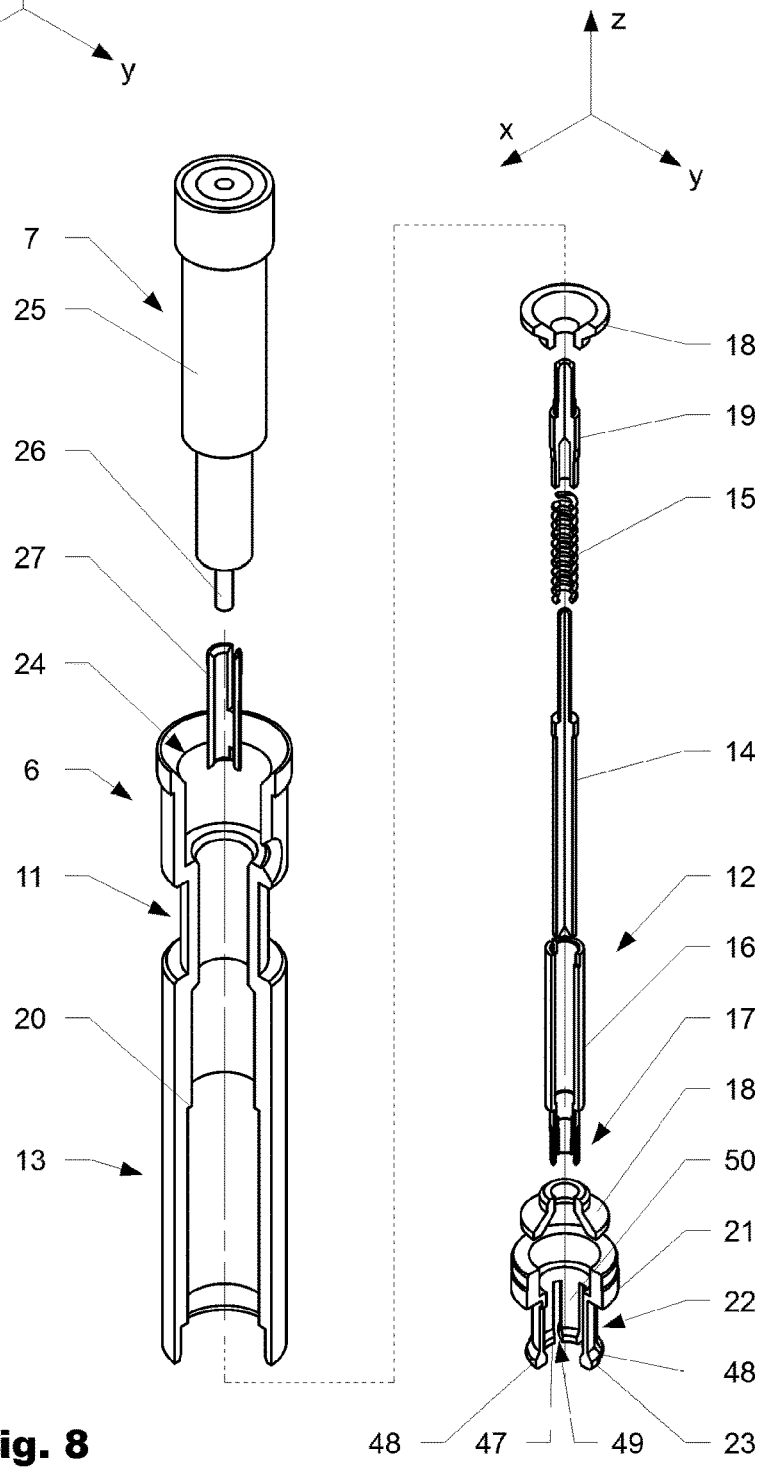
FIG. 8 The jack assembly according to FIG. 7 in an exploded manner.

FIG. 7 shows a jack assembly 6 and a coaxial cable 7 in a partially cut manner. FIG. 8 shows the jack assembly 6 in a disassembled manner along vertical axis z.

Figure 9:
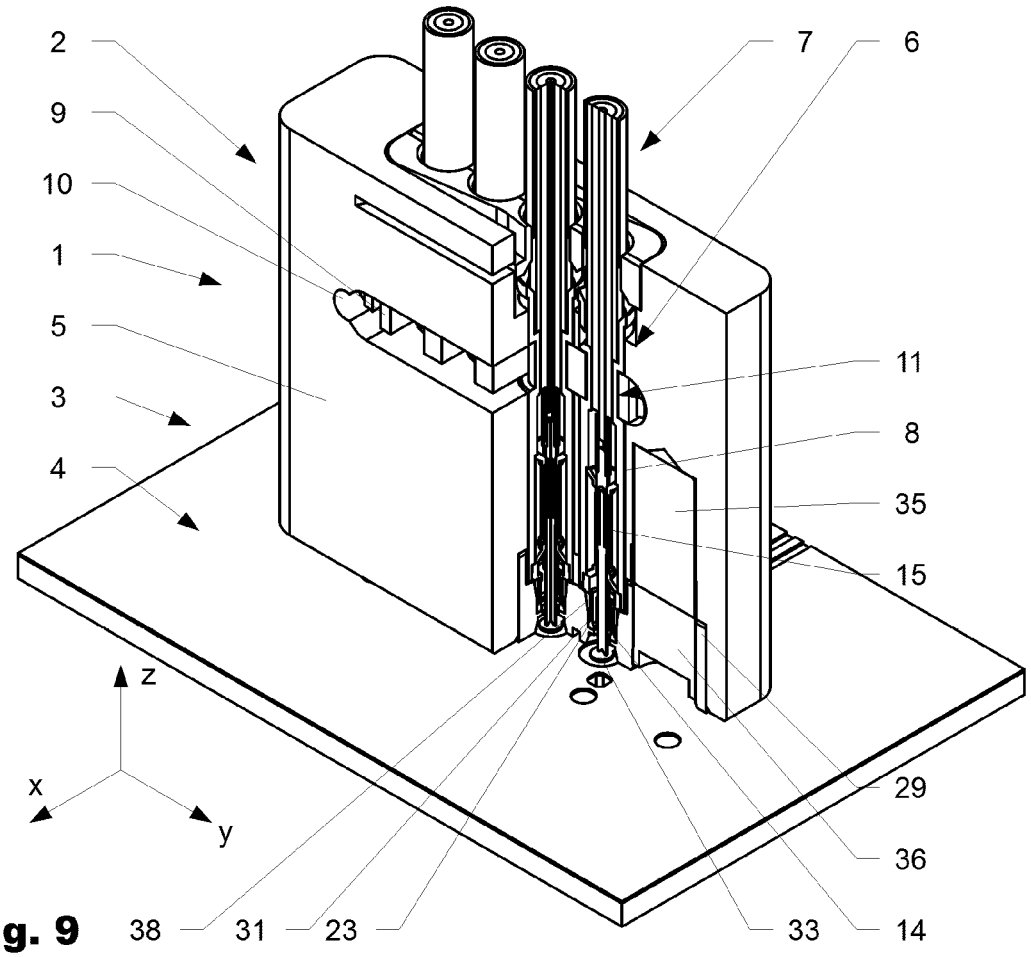
FIG. 9 The first and the second connector part of the first embodiment in a mated position and partially cut.
Figure 10:
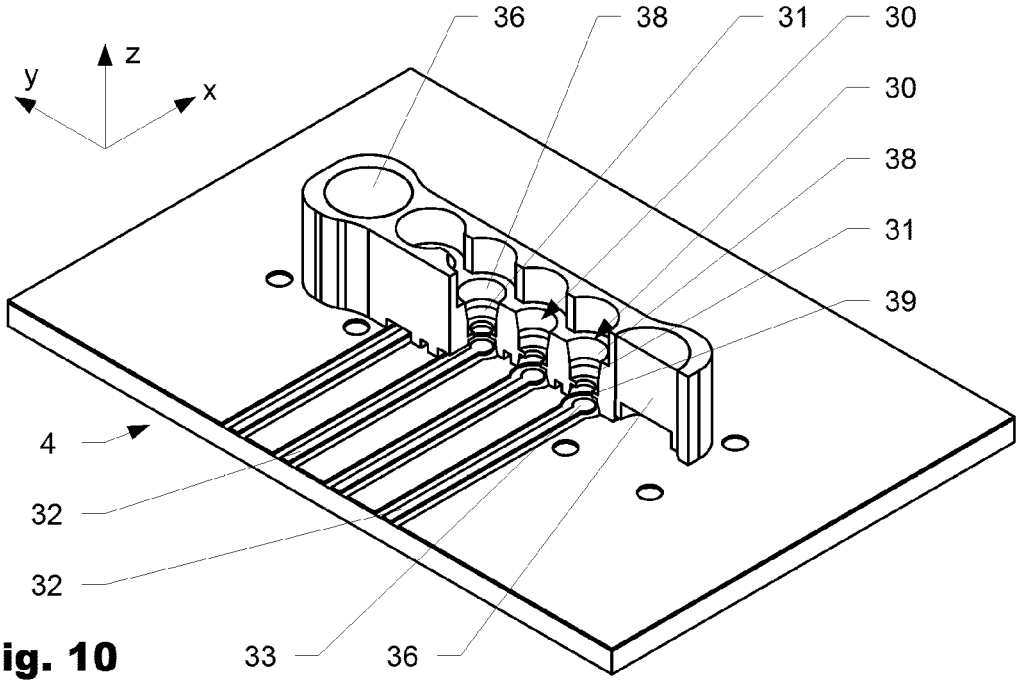
FIG. 10 A second connector part above a PCB in a perspective manner.

FIG. 9 shows the board connector 1 according to the first variation in a partially cut manner, wherein the first and the second connector 2, 3 are interconnected to each other. FIG. 10 shows the second connector 3 according to the first variation in a partially cut manner arranged above a printed circuit board (PCB) 4.

In the shown variations, it is foreseen to design the second connectors 3 very simple and low cost compared to the first connectors 2, as the second connectors 3 are foreseen to be attached to the printed circuit board (PCB) 4 and are used primarily for testing of the PCB and the thereto attached components. While the second connector 3 is normally foreseen to be mated only a couple of times, in comparison the first connector 2 is designed to be mated many times.

As e.g. visible in FIGS. 5 and 6, the first connector 2 comprises a housing 5 in which one or several jack assemblies 6 are arranged. The jack assemblies 6 are described in more detail in FIGS. 7 and 8. Depending on the field of application, other jack assemblies can be foreseen. The jack assemblies 6 are arranged in a lateral direction (x, y) in a floating manner with respect to the housing 5. In the shown variation, the jack assemblies 6 are in openings 8 arranged parallel to each other in a vertical direction (z). As it can be seen, several jack assemblies 6 are interconnected to the housing 5 by a comb like fixation element 9 which is inserted in a transversal direction into a transversal slot 10 arranged in the housing 5. In an assembled position, the fixation element 9 reaches between the jack assemblies 6 interconnecting to a circumferential slot 11 of the jack assemblies 6, thereby preventing unwanted falling out of the jack assemblies 6 from the housing 5. The jack assemblies 6 are arranged in a row with respect to each other in a lateral direction y. Depending on the field of application, based on the same concept connectors 3 can be made with more than one row if required.

As visible in FIGS. 7 and 8, a jack assembly 6 comprises an inner conductor 12 and an outer conductor 13. In the shown variation, the inner and the outer conductor 12, 13 each comprise several parts. The inner conductor 12 comprises a pin 14 arranged displaceable in axial direction (z-axis) against the force of a spring 15. The pin 14 is guided in a bushing 16 which comprises at its lower end spring loaded contact fingers 17 which are arranged in a circumferential manner around the pin 14 and contact the pin 14 in a radial direction independent of its position. The inner conductor 12 is held with respect to the outer conductor 13 by spacers 18. Depending on the field of application, other shaped spacers or number of spacers would be possible. In the shown variation, the spacers 18 are shaped conical and support the inner conductor 12 with respect to the outer conductor 13. The spacers 18 are made from an insulating material and act as insulators to electrically separate the inner conductor 12 from the outer conductor 13. Good results can be achieved when the insulators 18 are e.g. made from PEEK.

The pin 14 with the spring 15 sitting on its back is inserted into bushing 16. The rear end of the bushing 16 is closed by a stopper 19, which acts as a counter bearing for the spring 15. In a further step, the first and the second spacer 18 are arranged on the assembly which is then inserted into the outer conductor 13 from the lower end up to a shoulder 20. The assembly is then secured inside the outer conductor 13 by a crown 21 which is press fit to the outer conductor 13 and which comprises elastic contact fingers 22 which protrude in the shown view downward (z-axis). The contact fingers 22 comprise a contact zone 23, which protrude in a radial direction and which are foreseen to form contact with second connector 3 in a mounted position as described hereinafter. As visible in FIG. 8 the contact fingers 22 are separated from each other by cutting slits 49. To improve a defined contact the contact zones 23 can have a flattening 48 in the area of the cutting slit 49. If appropriate a second bead 47 can be arranged on the inside of the outer conductor 13. The second bead 47 protrudes inwardly above an inner surface 50 of the outer conductor 13. In the shown variation it is arranged on the level of the contact zone 23. It supports an improved return loss and insertion loss performance for broad frequency range. If appropriate more than one bead can be present. Good results are achieved if the second bead 47 is arranged close to the free end of the contact fingers 22 as shown.

The outer conductor 13 comprises at is cable sided end an opening 24 suitable to receive an outer conductor 25 of the coaxial cable 7. An inner conductor 26 of the coaxial cable 7 is interconnected to the inner conductor 12 of the jack assembly 6 by an adapter bushing 27. In the shown variation, the outer conductor 25 of the coaxial cable 7 is interconnected to the outer conductor 13 of the jack assembly 6 by soldering. The outer conductor 13 comprises an opening 28 to apply soldering material (not shown) in an optimized manner. Depending on the field of application other possibilities exist alternatively or in addition, e.g. by clamping.

As e.g. visible in FIG. 10, the second connector 3 has, compared to the prior art, a very simple and cost effective design. As it comprises in principle only a socket 29 and a thereto interconnected printed circuit board 4. The socket 29 is made from a conductive material or at least partially covered by a conductive material. The socket 29, which is here made in one piece, comprises several openings 30 arranged in a line and parallel to each other. The openings 30 are foreseen to receive a jack assembly 6 as described herein before. The openings 30 may have a graduated design primarily to optimize return loss and insertion loss performance for broad frequency range. The openings 30 comprise a first contact surface 31 foreseen to be in electrical contact with the crown contact 21 of an interconnected jack assembly 6. The first contact surface 31 contacts the crown contact 21 in a radial direction. Depending on the field of application, it can have a cylindrical and/or a conical shape and/or being interconnected to a lead-in surface 38. While the socket 29 is relevant for the ground contact by the outer conductor 13, the printed circuit board 4 comprises at least one conductor path 32 with at least one second contact surface 33 terminating the conductor path 32. The at least one second contact surface 33 on the PCB 4 is arranged underneath (coaxial) to an opening 30 in the socket 29, i.e. the second contact surface 33 is arranged in the direction of the opening 30 with respect to the plugging direction. The second contact surface 33 is foreseen to connect to the pin 14 of an inner conductor 12 of a jack assembly 6 when the first and the second connector 2, 3 of a connector assembly 1 according to the invention are attached to each other. Between the first contact surface 31 and the second contact surface 33 a restriction can be foreseen, e.g. in the form of a first bead 39 which protrudes inwardly above the first contact surface 31. By design of the first bead 39 influence can be taken in an effective manner on the return loss of the board connector assembly 1.

During mating of the first and the second connector 2, 3, in an axial direction (z-axis) schematically indicated in FIG. 4 by the dotted lines 34, the at least one pin 14 is displaced in axial direction (z-direction) against the force of the spring 15. The pin 14 is pressed by the spring 15 against the contact surface 33 thereby resulting in a reliable electrical interconnection.

To hold the first and the second connector 2, 3 in place when interconnected to each other, first and second locking means 35, 36 can be foreseen. While the first locking means 35 are attached to the first connector 2, the second locking means 36 are preferably attached to the socket 29 and/or the PCB 4.

Good results can be achieved when the first and the second locking means 35, 36 comprise a magnet (see e.g. FIG. 4 and FIG. 6), e.g. in that the first connector 2 comprises at least one magnet 35 and the second connector 3 comprises a counter element 36 interacting with the magnet 35. The counter element 36 can be made from or comprise a ferromagnetic material. Alternatively or in addition, the locking means 35, 36 can be based on a screw connection and/or a snap connection. E.g. in the variation shown in FIG. 3 the first locking means are two fastening bolts 35 which can be interconnected with a mating threads 36 which act as a second locking means arranged at the socket 29 on both sides of the openings 30.

In a preferred embodiment the connector assemblies 1 normally comprise a first connector 2 and a second connector 3. The first connector 2 comprises a housing 5 holding at least one jack assembly 6, comprising an inner conductor 12 and an outer conductor 13 arranged coaxial to the inner conductor 12. The second connector 3 comprises a socket 29 with at least one opening 30 extending in an axial direction z, said opening 30 comprising a contact surface 31. The contact surface 31 in a mated position is electrically interconnected to an outer conductor 13 of a corresponding jack assembly 6. In direction of the axial extension (z-direction) of the opening 30 a contact surface 33 is arranged which in the mated position is electrically interconnected to the inner conductor 12 of the first connector part 2. The inner conductor 12 comprises a pin 14 which is arranged displaceable in the axial direction z. The pin 14 is arranged in a bushing 16 comprising contact fingers 17 arranged in a circumferential direction around and in electrical contact with the pin 14. The socket 29 is at least partially made from a conductive material or is at least partially covered by a conductive material. The contact surface 33 is a conductor path 32 or interconnected to a conductor path 32 of a printed circuit board 4 as shown in the drawings. The first connector 2 comprises an outer housing 5 suitable to mate with the socket 29. The first and the second locking means 35, 36 are foreseen to interconnect in a mounted position the first connector 2 and the second connector 3 to each other. The first and the second locking means 35, 36 may comprise a magnetic connection and/or a snap connection and/or a screw connection. At least one jack assembly 7 may be arranged in a floating manner at least in a lateral direction. The at least one jack assembly 7 is mechanically interconnected to the housing 5 of the first connector part 2 by a fixation element 9. The first connector 2 comprises means to protect the at least one inner conductor 12. As e.g. shown in FIG. 2 and the exploded view of FIG. 5 the means to protect the inner conductor 12, respectively the sensitive pin 14, may comprise a protective element in the form of a casing 37 which is arranged displaceable with respect to the housing 5 in the axial direction (z) of the first connector 2. The casing 37 encompasses the housing 5 and can be moved between a first forward and a second rearward position. In the forward position the casing 37 is arranged around the pins 14 protecting them from outside damage. For mating with the second connector 3, the casing 37 is slid from the forward into the rearward position in which the pins 14 become accessible from the outside (see e.g. FIG. 4). In the shown variation the casing 37 and the housing 5 are interconnected to each other by two springs 42 and two actuators 43 arranged opposite to each other on both sides of the housing 5. The springs 42 are arranged in recesses 44 and the actuators 43 are arranged in thereto connected grooves 45. When mating the first and the second connector 2, 3 the first connector 2 is arranged above the second connector 3 arranged on the printed circuit board 4 as shown in FIG. 2. In the shown variation the socket 29 comprises a cavity 46 foreseen to receive the first connector 2 on the inside. An outer wall 47 of the cavity 46 interacts with the casing 37 and thereby pre-aligns the first with respect to the second connector 2, 3 in lateral direction (x,y) during mating. By the actuators 43 the housing 5 is pressed against the force of the springs 42 in the direction of the socket 29 until the first and the second locking means 35, 36 interact and hold the first with respect to the second connector 2, 3 in place. The housing as described above can be used with other jack assemblies as described herein and therefore should be considered as individual inventive concept.

Rather, the words used in the specification are words of description rather than limitation, and it is understood that various changes may be made without departing from the Spirit and scope of the invention.

The invention claimed is:

1. A board connector assembly (1) comprising a first connector (2) and a second connector (3) wherein a. the first connector (2) comprises a housing (5) holding at least one jack assembly (7), comprising an inner conductor (12) and an outer conductor (13) arranged coaxial to the inner conductor (12), wherein b. the second connector (3) comprises a socket (29) with at least one opening (30) extending in an axial direction (z), said opening (30) comprising a first contact surface (31), wherein c. the first contact surface (31) in a mated position is electrically interconnected to an outer conductor (13) of the jack assembly (7) in a radial direction and wherein d. in axial direction (z) of the opening (30) a second contact surface (33) is arranged which in the mated position is electrically interconnected to the inner conductor (12) of the first connector part (2) in the axial direction (z)

wherein the inner conductor (12) comprises a pin (14) which is arranged displaceable in the axial direction (z) against the force of a spring and wherein the spring and the pin (14) are arranged in a conductive bushing (16) forming part of the inner conductor comprising spring loaded contact fingers (17) arranged in a circumferential direction around and in electrical contact with the pin (14) and contact the pin (14) in a radial direction independent of its position.

2. The board connector assembly (1) according to claim 1, wherein the first contact surface (31) is at least partially cylindrical and/or conically shaped.

3. The board connector assembly (1) according to claim 1, wherein the first contact surface (31) has or is arranged adjacent to a funnel shaped lead-in surface (38).

4. The board connector assembly (1) according to claim 1, wherein the opening (30) comprises at least one restriction in the form of circumferential first bead (39) protruding inwardly above the first contact surface (31).

5. The board connector assembly (1) according to claim 1, wherein the socket (29) is at least partially made from a conductive material or is at least partially covered by a conductive material.

6. The board connector assembly (1) according to claim 1, wherein the second contact surface (33) is a conductor path (32) or interconnected to a conductor path (32) of a printed circuit board (4).

7. The board connector assembly (1) according to claim 1, wherein the first connector (2) comprises an outer housing (5) configured to mate with the socket (29).

8. The board connector assembly (1) according to claim 7, wherein the socket (29) comprises a cavity (46) configured to receive the first connector (2).

9. The board connector assembly (1) according to claim 4, wherein first and second locking means (35, 36) interconnect in a mounted position the first connector (2) and the second connector (3) to each other.

10. The board connector assembly (1) according to claim 5, wherein the first and the second locking means (35, 36) comprise a magnetic connection and/or a snap connection and/or a screw connection.

11. The board connector assembly (1) according to claim 1, wherein at least one jack assembly (7) is arranged in a floating manner at least in a lateral direction.

12. The board connector assembly (1) according to claim 1, wherein the at least one jack assembly (7) is mechanically interconnected to the housing (5) of the first connector part (2) by a fixation element (9).

13. The board connector assembly (1) according to claim 1, wherein the first connector (2) comprises means to protect the at least one inner conductor (12).

14. The board connector assembly (1) according to claim 13, wherein the means to protect the inner conductor (12) comprises a protective element (37) which is arranged displaceable with respect to the housing (5) of the first connector (2).

15. The board connector assembly (1) according to claim 1, wherein the outer conductor (13) comprises a second bead (47) which protrudes inwardly above an inner surface (50) of the outer conductor (13).

16. A first connector (2) suitable to be used in a board connector assembly according to claim 1.

17. A second connector (3) suitable to be used in a board connector assembly according to claim 1.

18. A method for interconnecting a first connector (2) and a second connector (3) to form a board connector assembly (1) according to claim 1 comprising the following method steps:

a. arranging the first connector (2) spaced a distance apart in the axial direction (z) above the second connector (3), said second connector (3) comprising the socket (29) being arranged on and interconnected to a printed circuit board (4);

b. moving the first connector (2) in the axial direction (z) to the second connector (3) until a crown contact of an outer conductor (13) of at least one jack assembly (6) held by the housing (5) of the first connector (2) interacts with the first contact surface (31) of the socket (29) of the second connector (3) in a radial direction;

c. continue moving the first connector (2) in the axial direction (z) with respect to the second connector (3) until the pin (14) of the jack assembly (6) contacts the second contact surface (33) in the axial direction (z).

19. The method according to claim 18, wherein the first connector (2) is moved against the second connector (3) until the pin (14) is displaced against the force of a spring (15).

20. The method according to claim 18, wherein the outer conductor (13) of the jack assembly (6) comprises a crown contact (21) with contact fingers (21) with contact zones (23) protruding in radial direction and which are deformed in the radial direction when interacting with the first contact surface (31).

* * * * *